US008403037B2

(12) United States Patent
Agrawal et al.

(10) Patent No.: US 8,403,037 B2
(45) Date of Patent: Mar. 26, 2013

(54) DISSOLVABLE TOOL AND METHOD

(75) Inventors: Gaurav Agrawal, Aurora, CO (US); Zhiyue Xu, Cypress, TX (US)

(73) Assignee: Baker Hughes Incorporated, Houston, TX (US)

( * ) Notice: Subject to any disclaimer, the term of this patent is extended or adjusted under 35 U.S.C. 154(b) by 459 days.

(21) Appl. No.: 12/633,662

(22) Filed: Dec. 8, 2009

(65) Prior Publication Data

US 2011/0132619 A1 Jun. 9, 2011

(51) Int. Cl.
*E21B 33/12* (2006.01)
*E21B 29/02* (2006.01)

(52) U.S. Cl. ..... 166/193; 166/376

(58) Field of Classification Search ..... 166/300, 166/376, 193, 153; 156/247, 248, 701–719; 277/331, 316; 428/576, 559
See application file for complete search history.

(56) References Cited

U.S. PATENT DOCUMENTS

| | | | | |
|---|---|---|---|---|
| 2,238,895 | A * | 4/1941 | Gage | 175/317 |
| 2,261,292 | A | 11/1941 | Salnikov | |
| 3,106,959 | A | 10/1963 | Huitt et al. | |
| 3,326,291 | A | 6/1967 | Zandmer et al. | |
| 3,390,724 | A | 7/1968 | Caldwell | |
| 3,637,446 | A * | 1/1972 | Elliott et al. | 156/69 |
| 3,645,331 | A * | 2/1972 | Maurer et al. | 175/65 |
| 3,775,823 | A | 12/1973 | Adolph et al. | |
| 3,894,850 | A | 7/1975 | Kovalchuk et al. | |
| 4,010,583 | A | 3/1977 | Highberg | |
| 4,157,732 | A | 6/1979 | Fonner | |
| 4,499,048 | A | 2/1985 | Hanejko | |
| 4,499,049 | A | 2/1985 | Hanejko | |
| 4,539,175 | A | 9/1985 | Lichti et al. | |
| 4,664,962 | A | 5/1987 | DesMarais, Jr. | |
| 4,673,549 | A | 6/1987 | Ecer | |
| 4,693,863 | A | 9/1987 | Del Corso et al. | |
| 4,716,964 | A | 1/1988 | Erbstoesser et al. | |
| 4,741,973 | A | 5/1988 | Condit et al. | |
| 4,853,056 | A | 8/1989 | Hoffman | |
| 4,929,415 | A | 5/1990 | Okazaki | |
| 4,952,902 | A | 8/1990 | Kawaguchi et al. | |
| 4,975,412 | A | 12/1990 | Okazaki et al. | |
| 5,084,088 | A | 1/1992 | Okazaki | |

(Continued)

FOREIGN PATENT DOCUMENTS

| | | |
|---|---|---|
| EP | 1798301 A1 | 8/2006 |
| JP | 2000185725 | 7/2000 |

(Continued)

OTHER PUBLICATIONS

International Search Report and Written Opinion; Mail Date Jul. 28, 2011; International Application No. PCT/US2010/057763; International Filing date Nov. 23, 2010; Korean Intellectual Property Office; International Search Report 7 pages; Written Opinion 3 pages.

(Continued)

*Primary Examiner* — Daniel P Stephenson
(74) *Attorney, Agent, or Firm* — Cantor Colburn LLP

(57) ABSTRACT

A method of dissolving a tool includes exposing an outer surface of the tool to an environment reactive with the tool, reacting the tool with the environment, and applying stress to the tool. The method also includes concentrating stress on the tool at stress risers in the outer surface, and initiating fracturing the tool at the stress risers.

12 Claims, 6 Drawing Sheets

U.S. PATENT DOCUMENTS

| | | | | |
|---|---|---|---|---|
| 5,252,365 | A | 10/1993 | White | |
| 5,292,478 | A | 3/1994 | Scorey | |
| 5,309,874 | A | 5/1994 | Willermet et al. | |
| 5,380,473 | A | 1/1995 | Bogue et al. | |
| 5,425,424 | A | 6/1995 | Reinhardt et al. | |
| 5,456,327 | A | 10/1995 | Denton et al. | |
| 5,479,986 | A | 1/1996 | Gano et al. | |
| 5,529,746 | A | 6/1996 | Knoss et al. | |
| 5,536,485 | A | 7/1996 | Kume et al. | |
| 5,772,735 | A | 6/1998 | Sehgal et al. | |
| 5,829,520 | A | 11/1998 | Johnson | |
| 5,941,309 | A * | 8/1999 | Appleton | 166/317 |
| 5,985,466 | A | 11/1999 | Atarashi et al. | |
| 6,069,313 | A | 5/2000 | Kay | |
| 6,189,618 | B1 * | 2/2001 | Beeman et al. | 166/312 |
| 6,228,904 | B1 | 5/2001 | Yadav et al. | |
| 6,238,280 | B1 | 5/2001 | Ritt et al. | |
| 6,261,432 | B1 | 7/2001 | Huber et al. | |
| 6,287,445 | B1 | 9/2001 | Lashmore et al. | |
| 6,341,747 | B1 | 1/2002 | Schmidt et al. | |
| 6,403,210 | B1 | 6/2002 | Stuivinga et al. | |
| 6,491,097 | B1 | 12/2002 | ONeal et al. | |
| 6,540,033 | B1 * | 4/2003 | Sullivan et al. | 175/40 |
| 6,612,826 | B1 | 9/2003 | Bauer et al. | |
| 6,613,383 | B1 | 9/2003 | George et al. | |
| 6,713,177 | B2 | 3/2004 | George et al. | |
| 6,887,297 | B2 | 5/2005 | Winter et al. | |
| 6,913,827 | B2 | 7/2005 | George et al. | |
| 6,939,388 | B2 | 9/2005 | Angeliu | |
| 7,013,998 | B2 | 3/2006 | Ray et al. | |
| 7,017,677 | B2 | 3/2006 | Keshavan et al. | |
| 7,168,494 | B2 | 1/2007 | Starr et al. | |
| 7,250,188 | B2 | 7/2007 | Dodelet et al. | |
| 7,322,417 | B2 | 1/2008 | Rytlewski et al. | |
| 7,350,582 | B2 | 4/2008 | McKeachnie et al. | |
| 7,353,879 | B2 | 4/2008 | Todd et al. | |
| 7,363,970 | B2 | 4/2008 | Corre et al. | |
| 7,401,648 | B2 | 7/2008 | Richard | |
| 7,416,029 | B2 | 8/2008 | Telfer et al. | |
| 7,441,596 | B2 | 10/2008 | Wood et al. | |
| 7,509,993 | B1 | 3/2009 | Turng et al. | |
| 7,559,357 | B2 | 7/2009 | Clem | |
| 7,579,087 | B2 | 8/2009 | Maloney et al. | |
| 7,604,049 | B2 | 10/2009 | Vaidya et al. | |
| 2002/0104616 | A1 | 8/2002 | De et al. | |
| 2002/0136904 | A1 | 9/2002 | Glass et al. | |
| 2003/0111728 | A1 | 6/2003 | Thai et al. | |
| 2003/0150614 | A1 | 8/2003 | Brown et al. | |
| 2004/0005483 | A1 | 1/2004 | Lin | |
| 2004/0231845 | A1 | 11/2004 | Cooke | |
| 2005/0102255 | A1 | 5/2005 | Bultman | |
| 2005/0161212 | A1 | 7/2005 | Leismer et al. | |
| 2005/0161224 | A1 | 7/2005 | Starr et al. | |
| 2005/0165149 | A1 | 7/2005 | Chanak et al. | |
| 2005/0194143 | A1 | 9/2005 | Xu et al. | |
| 2005/0205264 | A1 * | 9/2005 | Starr et al. | 166/376 |
| 2005/0205265 | A1 | 9/2005 | Todd et al. | |
| 2006/0012087 | A1 | 1/2006 | Matsuda et al. | |
| 2006/0045787 | A1 | 3/2006 | Jandeska et al. | |
| 2006/0057479 | A1 | 3/2006 | Niimi et al. | |
| 2006/0110615 | A1 | 5/2006 | Karim et al. | |
| 2006/0116696 | A1 | 6/2006 | Odermatt et al. | |
| 2006/0131031 | A1 | 6/2006 | McKeachnie et al. | |
| 2006/0144515 | A1 | 7/2006 | Tada et al. | |
| 2007/0044958 | A1 | 3/2007 | Rytlewski et al. | |
| 2007/0057415 | A1 | 3/2007 | Katagiri et al. | |
| 2007/0062644 | A1 | 3/2007 | Nakamura et al. | |
| 2007/0074873 | A1 | 4/2007 | McKeachnie et al. | |
| 2007/0107908 | A1 | 5/2007 | Vaidya et al. | |
| 2007/0131912 | A1 | 6/2007 | Simone et al. | |
| 2007/0151009 | A1 | 7/2007 | Conrad, III et al. | |
| 2007/0169935 | A1 * | 7/2007 | Akbar et al. | 166/284 |
| 2007/0181224 | A1 | 8/2007 | Marya et al. | |
| 2007/0221373 | A1 | 9/2007 | Murray | |
| 2007/0259994 | A1 | 11/2007 | Tour et al. | |
| 2007/0261862 | A1 | 11/2007 | Murray | |
| 2008/0020923 | A1 | 1/2008 | Debe et al. | |
| 2008/0047707 | A1 | 2/2008 | Boney et al. | |
| 2008/0081866 | A1 | 4/2008 | Gong et al. | |
| 2008/0105438 | A1 | 5/2008 | Jordan et al. | |
| 2008/0121436 | A1 | 5/2008 | Slay et al. | |
| 2008/0127475 | A1 | 6/2008 | Griffo | |
| 2008/0149351 | A1 | 6/2008 | Marya et al. | |
| 2008/0248205 | A1 | 10/2008 | Blanchet et al. | |
| 2008/0296024 | A1 | 12/2008 | Huang et al. | |
| 2008/0314588 | A1 | 12/2008 | Langlais et al. | |
| 2009/0038858 | A1 | 2/2009 | Griffo et al. | |
| 2009/0044946 | A1 | 2/2009 | Schasteen et al. | |
| 2009/0044949 | A1 | 2/2009 | King et al. | |
| 2009/0084600 | A1 | 4/2009 | Severance | |
| 2009/0152009 | A1 | 6/2009 | Slay et al. | |
| 2009/0159289 | A1 | 6/2009 | Avant et al. | |
| 2009/0226340 | A1 | 9/2009 | Marya | |
| 2009/0255667 | A1 | 10/2009 | Clem et al. | |
| 2010/0015002 | A1 | 1/2010 | Barrera et al. | |
| 2010/0294510 | A1 | 11/2010 | Holmes | |
| 2011/0132143 | A1 | 6/2011 | Xu et al. | |
| 2011/0132612 | A1 | 6/2011 | Agrawal et al. | |
| 2011/0132619 | A1 | 6/2011 | Agrawal et al. | |
| 2011/0132620 | A1 | 6/2011 | Agrawal et al. | |
| 2011/0135530 | A1 | 6/2011 | Xu et al. | |
| 2011/0135805 | A1 | 6/2011 | Doucet et al. | |
| 2011/0135953 | A1 | 6/2011 | Xu et al. | |
| 2011/0136707 | A1 | 6/2011 | Xu et al. | |

FOREIGN PATENT DOCUMENTS

| | | | |
|---|---|---|---|
| JP | 2004225084 | | 8/2004 |
| JP | 2004225765 | A | 8/2004 |
| JP | 2005076052 | A | 3/2005 |
| WO | 2008/057045 | A1 | 5/2008 |
| WO | WO2008079485 | | 7/2008 |

OTHER PUBLICATIONS

Notification of Transmittal of the International Search Report and the Written Opinion of the International Searching Authority; PCT/US2011/047000; Korean Intellectual Property Office; Mailed Dec. 26, 2011; 8 pages.

Notification of Transmittal of The International Search Report and the Written Opinion of the International Searching Authority; PCT/US2010/059257; Korean Intellectual Property Office; Mailed Jul. 27, 2011.

Notification of Transmittal of The International Search Report and the Written Opinion of the International Searching Authority; PCT/US2010/059268; International Searching Authority KIPO; Mailed Jun. 17, 2011.

Pardo, et al.; "Corrosion Behaviour of Magnesium/Aluminium Alloys in 3.5 wt% NaC1"; Corrosion Science; 50; pp. 823-834; (2008).

Notification of Transmittal of the International Search Report and Written Opinion, Mailed Jul. 8, 2011, International Appln. No. PCT/US2010/059263, Written Opinion 4 Pages, International Search Report 3 Pages.

Song, et al.; "Understanding Magnesium Corrosion"; Advanced Engineering Materials; 5; No. 12; pp. 837-858; (2003).

Abdoulaye Seyni, Nadine Le Bolay, Sonia Molina-Boisseau, "On the interest of using degradable fillers in co-ground composite materials", Powder Technology 190, (2009) pp. 176-184.

CH. Christoglou, N. Voudouris, G.N. Angelopoulos, M. Pant, W. Dahl, "Deposition of Aluminum on Magnesium by a CVD Process", Surface and Coatings Technology 184 (2004) 149-155.

Constantin Vahlas, Bri Gitte Caussat, Philippe Serp, George N. Angelopoulos, "Principles and Applications of CVD Powder Technology", Materials Sciene and Engineering R 53 (2006) 1-72.

Guan Ling Song, Andrej Atrens "Corrosion Mechanisms of Magnesium Alloys", Advanced Engineering Materials 1999, 1, No. 1, pp. 11-33.

H. Hermawan, H. Alamdari, D. Mantovani and Dominique Dube, "Iron-manganese: new class of metallic degradable biomaterials prepared by powder metallurgy", Powder Metallurgy, vol. 51, No. 1, (2008), pp. 38-45.

J. Dutta Majumdar, B. Ramesh Chandra, B.L. Mordike, R. Galun, I. Manna, "Laser Surface Engineering of a Magnesium Alloy with AI +AI2O3", Surface and Cotaings Technology 179 (2004) 297-305.

J.E. Gray, B. Luan, "Protective Coatings on Magnesuim and Its Alloys—a Critical Review", Journal of Alloys and Compounds 336 (2002) 88-113.
Yihua Zhu, Chunzhong Li, Qiufang Wu, "The process of coating on ultrafine particles by surface hydrolysis reaction in a fluidized bed reactor", Surface and Coatings Technology 135 (2000) 14-17.
Flow Control Systems, [online]; [retrieved on May 20, 2010]; retrieved from the Internet http://www.bakerhughes.com/products-and-services/completions-and-productions/well-completions/packers-and-flow-control/flow-control-systems; 3 pages.
Optisleeve Sliding Sleeve, [online]; [retrieved on Jun. 25, 2010]; retrieved from the Internet weatherford.com/weatherford/groups/.../weatherfordcorp/WFT033159.pdf; 3 pages.
"Sliding Sleeve", Omega Completion Technology Ltd, Sep. 29, 2009, retrieved on: www.omega-completion.com; 2 pages.
Welch, William R. et al., "Nonelastomeric Sliding Sleeve Maintains Long Term Integrity in HP/HT Application: Case Histories"[Abstract Only], SPE Eastern Regional Meeting, Oct. 23-25, 1996, Columbus. Ohio; 1 page.
Baker Hughes Tools. "Baker Oil Tools Introduces Revolutionary Sand Control Completion Technology," May 2, 2005.
E. Paul Bercegeay et al., "A One-Trip Gravel Packing System"; Society of Petroleum Engineers, Offshort Technology Conference, SPE Paper No. 4771; Feb. 7-8, 1974.
Bybee, Karen. "One-Trip Completion System Eliminates Perforations," Completions Today, Sep. 2007, pp. 52-53.
Curtin, William and Brian Sheldon. "CNT-reinforced ceramics and metals," Materials Today, 2004, vol. 7, 44-49.
Yi Feng, Hailong Yuan, "Electroless Plating of Carbon Nanotubes with Silver" Journal fo Materials Science, 39, (2004) pp. 3241-3243.
E. Flahaut et al., "Carbon Nanotube-Metal-Oxide Nanocomposites: Microstructure, Electrical Conductivity and Mechanical Properties" Acta amter. 48 (2000) 3803-3812.
Galanty et al. "Consolidation of metal powders during the extrusion process," Journal of Materials Processing Technology (2002), pp. 491-496.
C.S. Goh, J. Wei, L C Lee, and M. Gupta, "Development of novel carbon nanotube reinforced magnesium nanocomposites using the powder metallurgy technique", Nanottechnology 17 (2006) 7-12.
Hjortstam et al. "Can we achieve ultra-low resistivity in carbon nanotube-based metal composites," Applied Physics A (2004), vol. 78, Issue 8, pp. 1175-1179. [Abstract Only].
Notification of Transmittal of the International Search Report and the Written Opinion of the International Searching Authority; PCT/US2010/059259; International Searching Authority KIPO; Mailed Jun. 13, 2010.
Notification of Transmittal of the International Search Report and the Written Opinion of the International Searching Authority; PCT/US2010/059265; International Searching Authority KIPO; Mailed Jun. 16, 2011.
Toru Kuzumaki, Osamu Ujiie, Hideki Ichinose, and Kunio Ito, "Mechanical Characteristics and Preparation of Carbon Nanotube Fiber-Reinforced Ti Composite", Advanced Engineering Materials, 2000, 2, No. 7.
Stephen P. Mathis, "Sand Management: A Review of Approaches and Concerns"; Society of Petroleum Engineers, SPE Paper No. 82240; SPE European Formation Damage Conference, The Hague, The Netherlands, May 13-14, 2003.
Nie, Xiaowu. "Patents of Methods to Prepare Intermetallic Matrix Composites: A Review," Recent Patents on Materials Science 2008, vol. 1, pp. 232-240.
Shimizu et al., "Multi-walled carbon nanotube-reinforced magnesium alloy composites", Scripta Materialia, vol. 58, Issue 4, pp. 267-270.
Song, G. and S. Song. "A Possible Biodegradable Magnesium Implant Material," Advanced Engineering Materials, vol. 9, Issue 4, Apr. 2007, pp. 298-302. [Abstract Only].
Jing Sun, Lian Gao, Wei Li, "Colloidal Processing fo Carbon Nanotube/Alumina Composites" Chem. Mater. 2002, 14, 5169-5172.
Xiaotong Wang et al., "Contact-Damage-Resistant Ceramic/Single-Wall Carbon Nanotubes and Ceramic/Graphite Composites" Nature Materials, vol. 3, Aug. 2004, pp. 539-544.
Y. Zhang and Hongjie Dai, "Formation of metal nanowires on suspended single-walled carbon nanotubes" Applied Physics Letter, vol. 77, No. 19 (2000), pp. 3015-3017.
Zeng et al. "Progress and Challenge for Magnesium Alloys as Biomaterials," Advanced Engineering Materials, vol. 10, Issue 8, Aug. 2008, pp. B3-B14. [Abstract Only].
Guo-Dong Zhan, Joshua D. Kuntz, Julin Wan and Amiya K. Mukherjee, "Single-wall carbon nanotubes as attractive toughening agents in alumina-based nanocomposites" Nature Materials, vol. 2., Jan. 2003. 38-42.
Y. Zhang, Nathan W. Franklin, Robert J. Chen, Hongjie Dai, "Metal Coating on Suspended Carbon Nanotubes and its Implication to Metal—Tube Interaction", Chemical Physics Letters 331 (2000) 35-41.

* cited by examiner

DISSOLVABLE TOOL AND METHOD

CROSS REFERENCE TO RELATED APPLICATIONS

This application contains subject matter related to the subject matter of co-pending applications, which are assigned to the same assignee as this application, Baker Hughes Incorporated of Houston, Tex. and are all being filed on Dec. 8, 2009. The below listed applications are hereby incorporated by reference in their entirety:

U.S. patent application Ser. No. 12/633,682, entitled NANOMATRIX POWDER METAL COMPACT;

U.S. patent application Ser. No. 12/633,686, entitled COATED METALLIC POWDER AND METHOD OF MAKING THE SAME;

U.S. patent application Ser. No. 12/633,688, entitled METHOD OF MAKING A NANOMATRIX POWDER METAL COMPACT;

U.S. patent application Ser. No. 12/633,678, entitled ENGINEERED POWDER COMPACT COMPOSITE MATERIAL;

U.S. patent application Ser. No. 12/633,683, entitled TELESCOPIC UNIT WITH DISSOLVABLE BARRIER;

U.S. patent application Ser. No. 12/633,677 entitled MULTI-COMPONENT DISAPPEARING TRIPPING BALL AND METHOD FOR MAKING THE SAME; and U.S. patent application Ser. No. 12/633,668, entitled DISSOLVING TOOL AND METHOD.

BACKGROUND

In the subterranean drilling and completion industry there are times when a downhole tool located within a wellbore becomes an unwanted obstruction. Accordingly, downhole tools have been developed that can be deformed, by operator action, for example, such that the tool's presence becomes less burdensome. Although such tools work as intended, their presence, even in a deformed state can still be undesirable. Devices and methods to further remove the burden created by the presence of unnecessary downhole tools are therefore desirable in the art.

BRIEF DESCRIPTION

Disclosed herein is a method of dissolving a tool. The method includes, exposing an outer surface of the tool to an environment reactive with the tool, reacting the tool with the environment, applying stress to the tool, concentrating stress on the tool at stress risers in the outer surface, and initiating fracturing the tool at the stress risers.

Further disclosed herein is a dissolvable tool. The tool includes, a body having at least one stress riser configured to concentrate stress thereat to accelerate structural degradation of the body through chemical reaction under applied stress within a reactive environment.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
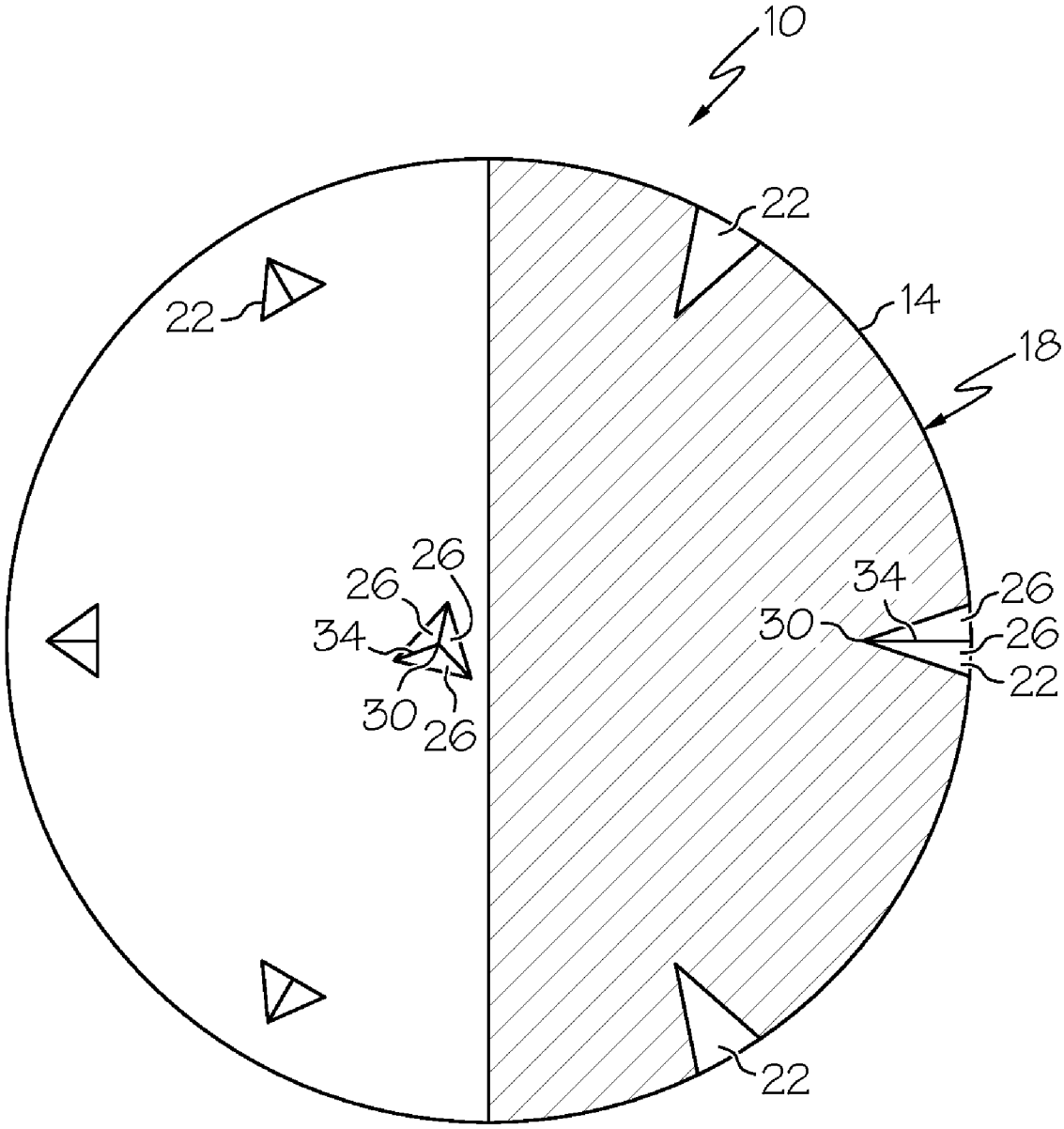
FIG. 1 depicts a quarter cross sectional view of a dissolvable tool disclosed herein.

Referring to FIG. 1, a quarter cross sectional view of an embodiment of a dissolvable tool disclosed herein is illustrated generally at 10. The tool 10, includes a body 14 illustrated in this embodiment as a ball, however, alternate embodiments are contemplated such as, an ellipsoid, a cylinder or a polyhedron, for example. The body 14 has a surface 18 that has a plurality of stress risers 22. The stress risers 22 illustrated herein are indentations, however, alternate embodiments may employ stress risers 22 with other configurations, such as, cracks or foreign bodies, for example. Additionally, alternate embodiments may employ any number of stress risers 22 including embodiments with just a single stress riser 22. The stress risers 22 are configured to concentrate stress at the specific locations of the body 14 where the stress risers 22 are located. This concentrated stress initiates micro-cracks that once nucleated propagate through the body 14 leading to fracture of the body 14. The stress risers 22 can, therefore, control strength of the body and define values of mechanical stress that will result in failure. Additionally, exposure of the body 14 to environments that are reactive with the material of the body 14 accelerates reaction of the body 14, such as chemical reactions, for example, at the locations of the stress risers 22. This accelerated reaction will weaken the body 14 further at the stress riser 22 locations facilitating fracture and dissolution of the tool 10.

In an application, such as in the downhole hydrocarbon recovery industry, for example, the tool 10 may be a tripping ball. The ball 10 can be dropped or pumped within a wellbore (not shown), where it seals with a seat allowing pressure to be applied thereagainst to actuate a mechanism, such as a fracturing valve, for example, to open ports in the wellbore to facilitate treatments, like fracturing or acid treating, of a formation. In this application the downhole environment may include high temperatures, high pressures, and caustic chemicals such as acids, bases and brine solutions, for example. By making the body 14 of a material, such as, a lightweight, high-strength metallic material usable in both durable and disposable or degradable articles as disclosed in greater detail starting in the paragraph below, the body 14 can be made to decrease in strength from exposure to the downhole environment. The initiation of dissolution or disintegration of the body 14 in the environment will decrease the strength of the body 14 and will allow the body 14 to fracture under stress, such as mechanical stress, for example. Examples of mechanical stress include stress from hydrostatic pressure and from a pressure differential applied across the body 14 as it is seated against a seat. The fracturing can break the body 14 into many small pieces that are not detrimental to further operation of the well, thereby negating the need to either pump the body 14 out of the wellbore or run a tool within the wellbore to drill or mill the ball into pieces small enough to remove hindrance therefrom.

The stress risers 22 of FIG. 1 are indentations that have a plurality of flat surfaces 26, with three surfaces 26 being shown, that extend from the surface 18 to a vertex 30. The vertex 30, being defined as a sharp intersection of the three surfaces 26, concentrates stress thereat. An additional stress concentration also occurs along lines 34 defined by the intersections of any two of the surfaces 26. Although the stress risers 22 shown here are indentations defined by flat surfaces 26, alternate embodiments may employ other stress risers 22 as will be described below.

Figure 2:
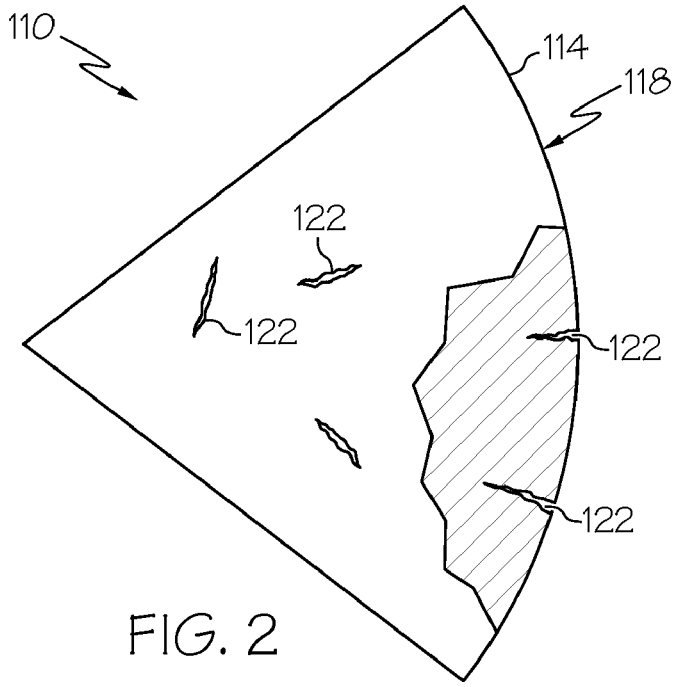
FIG. 2 depicts a partial sectioned view of an alternate embodiment of a dissolvable tool disclosed herein.

Referring to FIG. 2, a partial cross sectional view of an alternate embodiment of a dissolvable tool disclosed herein is illustrated generally at 110. The tool 110 has a body 114 that includes a plurality of stress risers 122 defined by cracks that extend radially inwardly from a surface 118 of the body 114.

Figure 3:
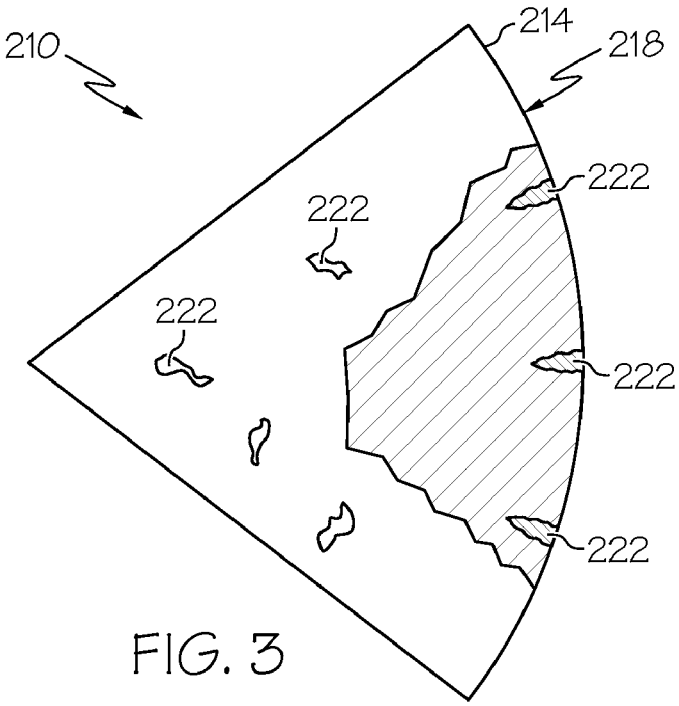
FIG. 3 depicts a partial sectioned view of an alternate embodiment of a dissolvable tool disclosed herein.

Referring to FIG. 3, a partial cross sectional view of an alternate embodiment of a dissolvable tool disclosed herein is illustrated generally at 210. The tool 20 has a body 214 that includes a plurality of stress risers 222 defined by foreign bodies 224 embedded therein. The foreign bodies 224 extend radially inwardly from a surface 218 of the body 214. The foreign bodies 224 can be any material other than the material from which the body 214 is made, however, making the foreign bodies 224 from a material more reactive with the anticipated environment may be desirable to accelerate the weakening of the body 214 further.

Figure 4:
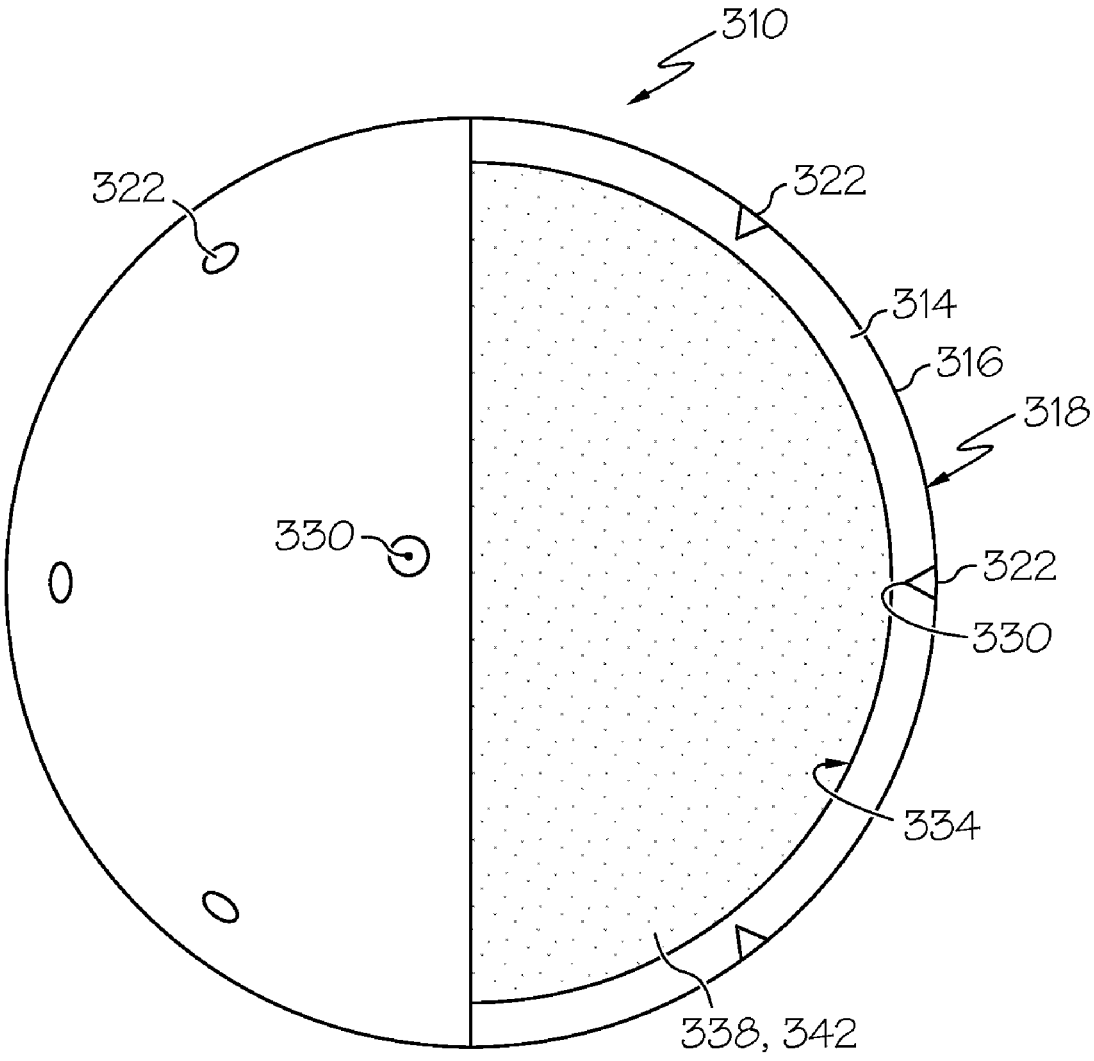
FIG. 4 depicts a quarter cross sectional view of an alternate embodiment of a dissolvable tool disclosed herein.

Referring to FIG. 4, a quarter cross sectional view of an alternate embodiment of a dissolvable tool disclosed herein is illustrated generally at 310. The tool 310 has a body 314 made of a shell 316 defining a surface 318. The shell 316 has a plurality of stress risers 322 that are shown in this embodiment as conical indentations that extend radially inwardly from the surface 318 to a vertex 330. The vertex 330 is located within the shell 316 and does not extend radially inwardly of an inner surface 334 of the shell 316. The body 314 may be hollow, may be filled with a fluid 338, may have a core 342 made of a fluidized material, such as a powder, that may provide some support to the shell 316 while easily dissolving within the environment once the shell 316 is fractured, or may have a solid core 346 made of a softer material than the shell 316.

The shell 316 of the tool 310 primarily determines the strength thereof. As such, once micro-cracks form in the shell 316 the compressive load bearing capability is significantly reduced leading to rupture shortly thereafter. Consequently, the stress risers 322 can accurately control timing of strength degradation of the tool 310 once the tool 310 is exposed to a reactive environment.

Materials for the body 14, 114, 214, 314, may include, lightweight, high-strength metallic materials are disclosed that may be used in a wide variety of applications and application environments, including use in various wellbore environments to make various selectably and controllably disposable or degradable lightweight, high-strength downhole tools or other downhole components, as well as many other applications for use in both durable and disposable or degradable articles. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in wellbore applications. These powder compacts provide a unique and advantageous combination of mechanical strength properties, such as compression and shear strength, low density and selectable and controllable corrosion properties, particularly rapid and controlled dissolution in various wellbore fluids. For example, the particle core and coating layers of these powders may be selected to provide sintered powder compacts suitable for use as high strength engineered materials having a compressive strength and shear strength comparable to various other engineered materials, including carbon, stainless and alloy steels, but which also have a low density comparable to various polymers, elastomers, low-density porous ceramics and composite materials. As yet another example, these powders and powder compact materials may be configured to provide a selectable and controllable degradation or disposal in response to a change in an environmental condition, such as a transition from a very low dissolution rate to a very rapid dissolution rate in response to a change in a property or condition of a wellbore proximate an article formed from the compact, including a property change in a wellbore fluid that is in contact with the powder compact. The selectable and controllable degradation or disposal characteristics described also allow the dimensional stability and strength of articles, such as wellbore tools or other components, made from these materials to be maintained until they are no longer needed, at which time a predetermined environmental condition, such as a wellbore condition, including wellbore fluid temperature, pressure or pH value, may be changed to promote their removal by rapid dissolution. These coated powder materials and powder compacts and engineered materials formed from them, as well as methods of making them, are described further below.

Figure 5:
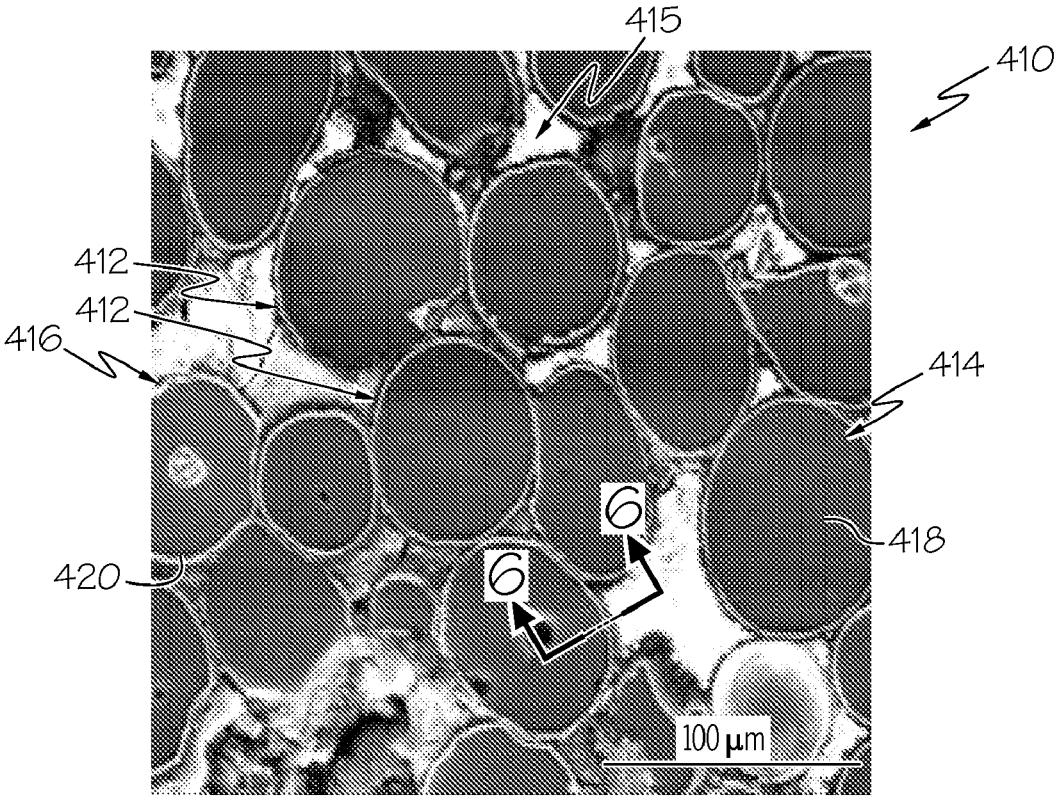
FIG. 5 is a photomicrograph of a powder as disclosed herein that has been embedded in a potting material and sectioned.

Referring to FIG. 5, a metallic powder 410 includes a plurality of metallic, coated powder particles 412. Powder particles 412 may be formed to provide a powder 410, including free-flowing powder, that may be poured or otherwise disposed in all manner of forms or molds (not shown) having all manner of shapes and sizes and that may be used to fashion powder compacts 600 (FIGS. 8 and 9), as described herein, that may be used as, or for use in manufacturing, various articles of manufacture, including various wellbore tools and components.

Each of the metallic, coated powder particles 412 of powder 410 includes a particle core 414 and a metallic coating layer 416 disposed on the particle core 414. The particle core 414 includes a core material 418. The core material 418 may include any suitable material for forming the particle core 414 that provides powder particle 412 that can be sintered to form a lightweight, high-strength powder compact 600 having selectable and controllable dissolution characteristics. Suitable core materials include electrochemically active metals having a standard oxidation potential greater than or equal to that of Zn, including as Mg, Al, Mn or Zn or a combination thereof. These electrochemically active metals are very reactive with a number of common wellbore fluids, including any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$). Core material 418 may also include other metals that are less electrochemically active than Zn or nonmetallic materials, or a combination thereof. Suitable nonmetallic materials include ceramics, composites, glasses or carbon, or a combination thereof. Core material 418 may be selected to provide a high dissolution rate in a predetermined wellbore fluid, but may also be selected to provide a relatively low dissolution rate, including zero dissolution, where dissolution of the nanomatrix material causes the particle core 414 to be rapidly undermined and liberated from the particle compact at the interface with the wellbore fluid, such that the effective rate of dissolution of particle compacts made using particle cores 414 of these core materials 418 is high, even though core material 418 itself may have a low dissolution rate, including core materials 420 that may be substantially insoluble in the wellbore fluid.

With regard to the electrochemically active metals as core materials 418, including Mg, Al, Mn or Zn, these metals may be used as pure metals or in any combination with one another, including various alloy combinations of these materials, including binary, tertiary, or quaternary alloys of these materials. These combinations may also include composites of these materials. Further, in addition to combinations with one another, the Mg, Al, Mn or Zn core materials 418 may also include other constituents, including various alloying additions, to alter one or more properties of the particle cores 414, such as by improving the strength, lowering the density or altering the dissolution characteristics of the core material 418.

Among the electrochemically active metals, Mg, either as a pure metal or an alloy or a composite material, is particularly useful, because of its low density and ability to form high-strength alloys, as well as its high degree of electrochemical activity, since it has a standard oxidation potential higher than Al, Mn or Zn. Mg alloys include all alloys that have Mg as an alloy constituent. Mg alloys that combine other electrochemically active metals, as described herein, as alloy constituents are particularly useful, including binary Mg—Zn, Mg—Al and Mg—Mn alloys, as well as tertiary Mg—Zn—Y and Mg—Al—X alloys, where X includes Zn, Mn, Si, Ca or Y, or a combination thereof. These Mg—Al—X alloys may include, by weight, up to about 85% Mg, up to about 15% Al and up to about 5% X. Particle core 414 and core material 418, and particularly electrochemically active metals including Mg, Al, Mn or Zn, or combinations thereof, may also include a rare earth element or combination of rare earth elements. As used herein, rare earth elements include Sc, Y, La, Ce, Pr, Nd or Er, or a combination of rare earth elements. Where present, a rare earth element or combinations of rare earth elements may be present, by weight, in an amount of about 5% or less.

Particle core 414 and core material 418 have a melting temperature ($T_p$). As used herein, $T_p$ includes the lowest temperature at which incipient melting or liquation or other forms of partial melting occur within core material 418, regardless of whether core material 418 comprises a pure metal, an alloy with multiple phases having different melting temperatures or a composite of materials having different melting temperatures.

Particle cores 414 may have any suitable particle size or range of particle sizes or distribution of particle sizes. For example, the particle cores 414 may be selected to provide an average particle size that is represented by a normal or Gaussian type unimodal distribution around an average or mean, as illustrated generally in FIG. 5. In another example, particle cores 414 may be selected or mixed to provide a multimodal distribution of particle sizes, including a plurality of average particle core sizes, such as, for example, a homogeneous bimodal distribution of average particle sizes. The selection of the distribution of particle core size may be used to determine, for example, the particle size and interparticle spacing 415 of the particles 412 of powder 410. In an exemplary embodiment, the particle cores 414 may have a unimodal distribution and an average particle diameter of about 5 μm to about 300 μm, more particularly about 80 μm to about 120 μm, and even more particularly about 100 μm.

Particle cores 414 may have any suitable particle shape, including any regular or irregular geometric shape, or combination thereof. In an exemplary embodiment, particle cores 414 are substantially spheroidal electrochemically active metal particles. In another exemplary embodiment, particle cores 414 are substantially irregularly shaped ceramic particles. In yet another exemplary embodiment, particle cores 414 are carbon or other nanotube structures or hollow glass microspheres.

Figure 6:
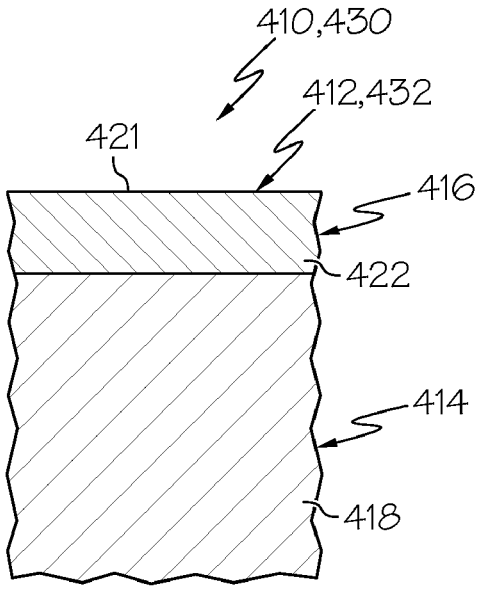
FIG. 6 is a schematic illustration of an exemplary embodiment of a powder particle as it would appear in an exemplary section view represented by section 6-6 of FIG. 5.

Each of the metallic, coated powder particles 412 of powder 410 also includes a metallic coating layer 416 that is disposed on particle core 414. Metallic coating layer 416 includes a metallic coating material 420. Metallic coating material 420 gives the powder particles 412 and powder 410 its metallic nature. Metallic coating layer 16 is a nanoscale coating layer. In an exemplary embodiment, metallic coating layer 416 may have a thickness of about 25 nm to about 2500 nm. The thickness of metallic coating layer 416 may vary over the surface of particle core 414, but will preferably have a substantially uniform thickness over the surface of particle core 414. Metallic coating layer 416 may include a single layer, as illustrated in FIG. 6, or a plurality of layers as a multilayer coating structure. In a single layer coating, or in each of the layers of a multilayer coating, the metallic coating layer 416 may include a single constituent chemical element or compound, or may include a plurality of chemical elements or compounds. Where a layer includes a plurality of chemical constituents or compounds, they may have all manner of homogeneous or heterogeneous distributions, including a homogeneous or heterogeneous distribution of metallurgical phases. This may include a graded distribution where the relative amounts of the chemical constituents or compounds vary according to respective constituent profiles across the thickness of the layer. In both single layer and multilayer coatings 416, each of the respective layers, or combinations of them, may be used to provide a predetermined property to the powder particle 412 or a sintered powder compact formed therefrom. For example, the predetermined property may include the bond strength of the metallurgical bond between the particle core 414 and the coating material 420; the interdiffusion characteristics between the particle core 414 and metallic coating layer 416, including any interdiffusion between the layers of a multilayer coating layer 416; the interdiffusion characteristics between the various layers of a multilayer coating layer 416; the interdiffusion characteristics between the metallic coating layer 416 of one powder particle and that of an adjacent powder particle 412; the bond strength of the metallurgical bond between the metallic coating layers of adjacent sintered powder particles 412, including the outermost layers of multilayer coating layers; and the electrochemical activity of the coating layer 416.

Metallic coating layer 416 and coating material 420 have a melting temperature ($T_C$). As used herein, $T_C$ includes the lowest temperature at which incipient melting or liquation or other forms of partial melting occur within coating material 420, regardless of whether coating material 420 comprises a pure metal, an alloy with multiple phases each having different melting temperatures or a composite, including a composite comprising a plurality of coating material layers having different melting temperatures.

Metallic coating material 420 may include any suitable metallic coating material 20 that provides a sinterable outer surface 421 that is configured to be sintered to an adjacent powder particle 412 that also has a metallic coating layer 416 and sinterable outer surface 421. In powders 410 that also include second or additional (coated or uncoated) particles 432, as described herein, the sinterable outer surface 421 of metallic coating layer 416 is also configured to be sintered to a sinterable outer surface 421 of second particles 432. In an exemplary embodiment, the powder particles 412 are sinterable at a predetermined sintering temperature ($T_S$) that is a function of the core material 418 and coating material 420, such that sintering of powder compact 600 is accomplished entirely in the solid state and where $T_S$ is less than $T_P$ and $T_C$. Sintering in the solid state limits particle core 414/metallic coating layer 416 interactions to solid state diffusion processes and metallurgical transport phenomena and limits growth of and provides control over the resultant interface between them. In contrast, for example, the introduction of liquid phase sintering would provide for rapid interdiffusion of the particle core 414/metallic coating layer 416 materials and make it difficult to limit the growth of and provide control over the resultant interface between them, and thus interfere with the formation of the desirable microstructure of particle compact 600 as described herein.

In an exemplary embodiment, core material 418 will be selected to provide a core chemical composition and the coating material 420 will be selected to provide a coating chemical composition and these chemical compositions will also be selected to differ from one another. In another exemplary embodiment, the core material 418 will be selected to provide a core chemical composition and the coating material 420 will be selected to provide a coating chemical composition and these chemical compositions will also be selected to differ from one another at their interface. Differences in the chemical compositions of coating material 420 and core material 418 may be selected to provide different dissolution rates and selectable and controllable dissolution of powder compacts 600 that incorporate them making them selectably and controllably dissolvable. This includes dissolution rates that differ in response to a changed condition in the wellbore, including an indirect or direct change in a wellbore fluid. In an exemplary embodiment, a powder compact 600 formed from powder 410 having chemical compositions of core material 418 and coating material 420 that make compact 600 is selectably dissolvable in a wellbore fluid in response to a changed wellbore condition that includes a change in temperature, change in pressure, change in flow rate, change in pH or change in chemical composition of the wellbore fluid, or a combination thereof. The selectable dissolution response to the changed condition may result from actual chemical reactions or processes that promote different rates of dissolution, but also encompass changes in the dissolution response that are associated with physical reactions or processes, such as changes in wellbore fluid pressure or flow rate.

Figure 7:
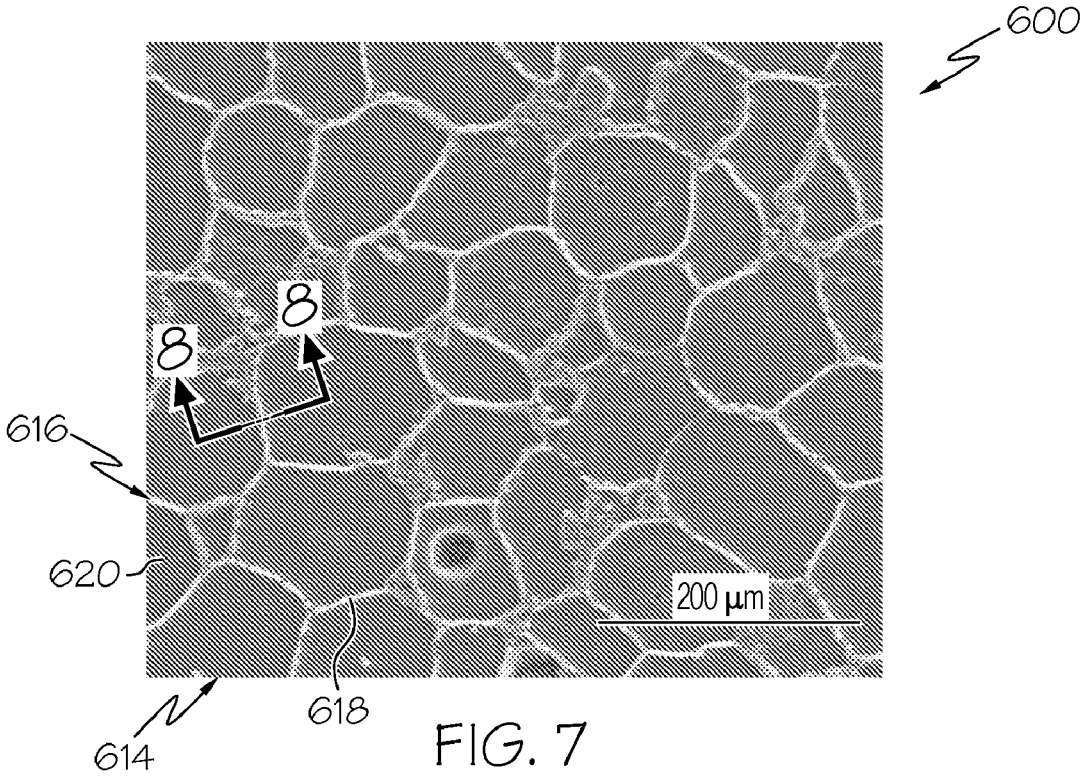
FIG. 7 is a photomicrograph of an exemplary embodiment of a powder compact as disclosed herein.

As illustrated in FIGS. 5 and 7, particle core 414 and core material 418 and metallic coating layer 416 and coating material 420 may be selected to provide powder particles 412 and a powder 410 that is configured for compaction and sintering to provide a powder compact 600 that is lightweight (i.e., having a relatively low density), high-strength and is selectably and controllably removable from a wellbore in response to a change in a wellbore property, including being selectably and controllably dissolvable in an appropriate wellbore fluid, including various wellbore fluids as disclosed herein. Powder compact 600 includes a substantially-continuous, cellular nanomatrix 616 of a nanomatrix material 620 having a plurality of dispersed particles 614 dispersed throughout the cellular nanomatrix 616. The substantially-continuous cellular nanomatrix 616 and nanomatrix material 620 formed of sintered metallic coating layers 416 is formed by the compaction and sintering of the plurality of metallic coating layers 416 of the plurality of powder particles 412. The chemical composition of nanomatrix material 620 may be different than that of coating material 420 due to diffusion effects associated with the sintering as described herein. Powder metal compact 600 also includes a plurality of dispersed particles 614 that comprise particle core material 618. Dispersed particle cores 614 and core material 618 correspond to and are formed from the plurality of particle cores 414 and core material 418 of the plurality of powder particles 412 as the metallic coating layers 416 are sintered together to form nanomatrix 616. The chemical composition of core material 618 may be different than that of core material 418 due to diffusion effects associated with sintering as described herein.

As used herein, the use of the term substantially-continuous cellular nanomatrix 616 does not connote the major constituent of the powder compact, but rather refers to the minority constituent or constituents, whether by weight or by volume. This is distinguished from most matrix composite materials where the matrix comprises the majority constituent by weight or volume. The use of the term substantially-continuous, cellular nanomatrix is intended to describe the extensive, regular, continuous and interconnected nature of the distribution of nanomatrix material 620 within powder compact 600. As used herein, "substantially-continuous" describes the extension of the nanomatrix material throughout powder compact 600 such that it extends between and envelopes substantially all of the dispersed particles 614. Substantially-continuous is used to indicate that complete continuity and regular order of the nanomatrix around each dispersed particle 614 is not required. For example, defects in the coating layer 416 over particle core 414 on some powder particles 412 may cause bridging of the particle cores 414 during sintering of the powder compact 600, thereby causing localized discontinuities to result within the cellular nanomatrix 616, even though in the other portions of the powder compact the nanomatrix is substantially continuous and exhibits the structure described herein. As used herein, "cellular" is used to indicate that the nanomatrix defines a network of generally repeating, interconnected, compartments or cells of nanomatrix material 620 that encompass and also interconnect the dispersed particles 614. As used herein, "nanomatrix" is used to describe the size or scale of the matrix, particularly the thickness of the matrix between adjacent dispersed particles 614. The metallic coating layers that are sintered together to form the nanomatrix are themselves nanoscale thickness coating layers. Since the nanomatrix at most locations, other than the intersection of more than two dispersed particles 614, generally comprises the interdiffusion and bonding of two coating layers 416 from adjacent powder particles 412 having nanoscale thicknesses, the matrix formed also has a nanoscale thickness (e.g., approximately two times the coating layer thickness as described herein) and is thus described as a nanomatrix. Further, the use of the term dispersed particles 614 does not connote the minor constituent of powder compact 600, but rather refers to the majority constituent or constituents, whether by weight or by volume. The use of the term dispersed particle is intended to convey the discontinuous and discrete distribution of particle core material 618 within powder compact 600.

Powder compact 600 may have any desired shape or size, including that of a cylindrical billet or bar that may be machined or otherwise used to form useful articles of manufacture, including various wellbore tools and components. The sintering and pressing processes used to form powder compact 600 and deform the powder particles 412, including particle cores 414 and coating layers 416, to provide the full density and desired macroscopic shape and size of powder compact 600 as well as its microstructure. The microstructure of powder compact 600 includes an equiaxed configuration of dispersed particles 614 that are dispersed throughout and embedded within the substantially-continuous, cellular nanomatrix 616 of sintered coating layers. This microstructure is somewhat analogous to an equiaxed grain microstructure with a continuous grain boundary phase, except that it does not require the use of alloy constituents having thermodynamic phase equilibria properties that are capable of producing such a structure. Rather, this equiaxed dispersed particle structure and cellular nanomatrix 616 of sintered metallic coating layers 416 may be produced using constituents where thermodynamic phase equilibrium conditions would not produce an equiaxed structure. The equiaxed morphology of the dispersed particles 614 and cellular network 616 of particle layers results from sintering and deformation of the powder particles 412 as they are compacted and interdiffuse and deform to fill the interparticle spaces 415 (FIG. 5). The sintering temperatures and pressures may be selected to ensure that the density of powder compact 600 achieves substantially full theoretical density.

Figure 8:
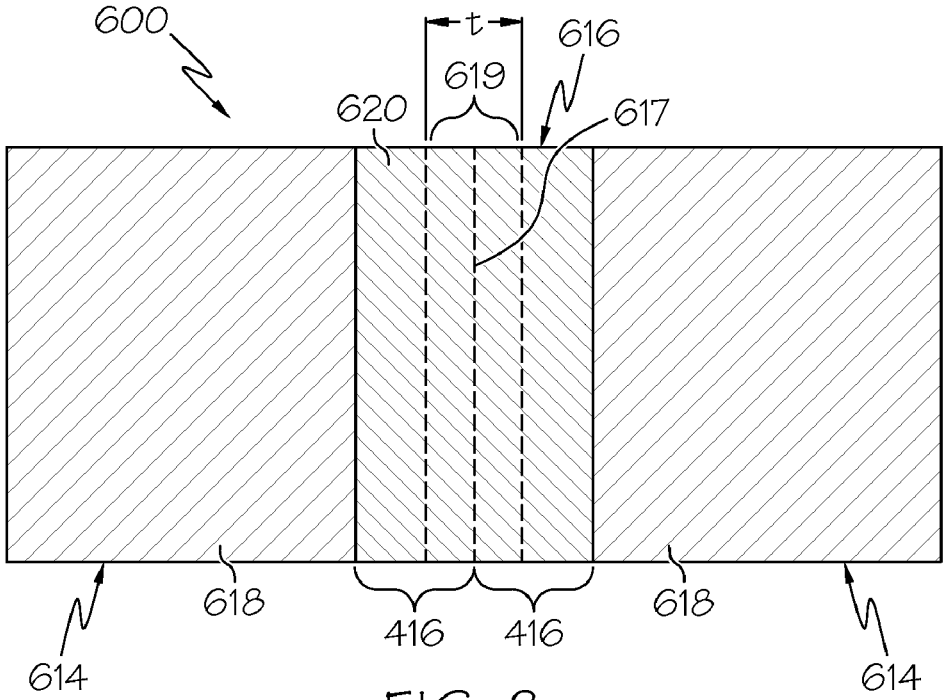
FIG. 8 is a schematic illustration of an exemplary embodiment of the powder compact of FIG. 7 made using a powder having single-layer powder particles as it would appear taken along section 8-8.

In an exemplary embodiment as illustrated in FIGS. 5 and 7, dispersed particles 614 are formed from particle cores 414 dispersed in the cellular nanomatrix 616 of sintered metallic coating layers 416, and the nanomatrix 616 includes a solid-state metallurgical bond 617 or bond layer 619, as illustrated schematically in FIG. 8, extending between the dispersed particles 614 throughout the cellular nanomatrix 616 that is formed at a sintering temperature ($T_S$), where $T_S$ is less than $T_C$ and $T_P$. As indicated, solid-state metallurgical bond 617 is formed in the solid state by solid-state interdiffusion between the coating layers 416 of adjacent powder particles 412 that are compressed into touching contact during the compaction and sintering processes used to form powder compact 600, as described herein. As such, sintered coating layers 416 of cellular nanomatrix 616 include a solid-state bond layer 619 that has a thickness (t) defined by the extent of the interdiffusion of the coating materials 420 of the coating layers 416, which will in turn be defined by the nature of the coating layers 416, including whether they are single or multilayer coating layers, whether they have been selected to promote or limit such interdiffusion, and other factors, as described herein, as well as the sintering and compaction conditions, including the sintering time, temperature and pressure used to form powder compact 600.

As nanomatrix 616 is formed, including bond 617 and bond layer 619, the chemical composition or phase distribution, or both, of metallic coating layers 416 may change. Nanomatrix 616 also has a melting temperature ($T_M$). As used herein, $T_M$ includes the lowest temperature at which incipient melting or liquation or other forms of partial melting will occur within nanomatrix 616, regardless of whether nanomatrix material 620 comprises a pure metal, an alloy with multiple phases each having different melting temperatures or a composite, including a composite comprising a plurality of layers of various coating materials having different melting temperatures, or a combination thereof, or otherwise. As dispersed particles 614 and particle core materials 618 are formed in conjunction with nanomatrix 616, diffusion of constituents of metallic coating layers 416 into the particle cores 414 is also possible, which may result in changes in the chemical composition or phase distribution, or both, of particle cores 414. As a result, dispersed particles 614 and particle core materials 618 may have a melting temperature ($T_{DP}$) that is different than $T_P$. As used herein, $T_{DP}$ includes the lowest temperature at which incipient melting or liquation or other forms of partial melting will occur within dispersed particles 614, regardless of whether particle core material 618 comprise a pure metal, an alloy with multiple phases each having different melting temperatures or a composite, or otherwise. Powder compact 600 is formed at a sintering temperature ($T_S$), where $T_S$ is less than $T_C$, $T_P$, $T_M$ and $T_{DP}$.

Dispersed particles 614 may comprise any of the materials described herein for particle cores 414, even though the chemical composition of dispersed particles 614 may be different due to diffusion effects as described herein. In an exemplary embodiment, dispersed particles 614 are formed from particle cores 414 comprising materials having a standard oxidation potential greater than or equal to Zn, including Mg, Al, Zn or Mn, or a combination thereof, may include various binary, tertiary and quaternary alloys or other combinations of these constituents as disclosed herein in conjunction with particle cores 414. Of these materials, those having dispersed particles 614 comprising Mg and the nanomatrix 616 formed from the metallic coating materials 416 described herein are particularly useful. Dispersed particles 614 and particle core material 618 of Mg, Al, Zn or Mn, or a combination thereof, may also include a rare earth element, or a combination of rare earth elements as disclosed herein in conjunction with particle cores 414.

In another exemplary embodiment, dispersed particles 614 are formed from particle cores 414 comprising metals that are less electrochemically active than Zn or non-metallic materials. Suitable non-metallic materials include ceramics, glasses (e.g., hollow glass microspheres) or carbon, or a combination thereof, as described herein.

Dispersed particles 614 of powder compact 600 may have any suitable particle size, including the average particle sizes described herein for particle cores 414.

Dispersed particles 614 may have any suitable shape depending on the shape selected for particle cores 414 and powder particles 412, as well as the method used to sinter and compact powder 410. In an exemplary embodiment, powder particles 412 may be spheroidal or substantially spheroidal and dispersed particles 614 may include an equiaxed particle configuration as described herein.

The nature of the dispersion of dispersed particles 614 may be affected by the selection of the powder 410 or powders 410 used to make particle compact 600. In one exemplary embodiment, a powder 410 having a unimodal distribution of powder particle 412 sizes may be selected to form powder compact 600 and will produce a substantially homogeneous unimodal dispersion of particle sizes of dispersed particles 614 within cellular nanomatrix 616, as illustrated generally in FIG. 7. In another exemplary embodiment, a plurality of powders 410 having a plurality of powder particles with particle cores 414 that have the same core materials 418 and different core sizes and the same coating material 420 may be selected and uniformly mixed as described herein to provide a powder 410 having a homogenous, multimodal distribution of powder particle 412 sizes, and may be used to form powder compact 600 having a homogeneous, multimodal dispersion of particle sizes of dispersed particles 614 within cellular nanomatrix 616. Similarly, in yet another exemplary embodiment, a plurality of powders 410 having a plurality of particle cores 414 that may have the same core materials 418 and different core sizes and the same coating material 420 may be selected and distributed in a non-uniform manner to provide a non-homogenous, multimodal distribution of powder particle sizes, and may be used to form powder compact 600 having a non-homogeneous, multimodal dispersion of particle sizes of dispersed particles 614 within cellular nanomatrix 616. The selection of the distribution of particle core size may be used to determine, for example, the particle size and interparticle spacing of the dispersed particles 614 within the cellular nanomatrix 616 of powder compacts 600 made from powder 410.

Nanomatrix 616 is a substantially-continuous, cellular network of metallic coating layers 416 that are sintered to one another. The thickness of nanomatrix 616 will depend on the nature of the powder 410 or powders 410 used to form powder compact 600, as well as the incorporation of any second powder 430, particularly the thicknesses of the coating layers associated with these particles. In an exemplary embodiment, the thickness of nanomatrix 616 is substantially uniform throughout the microstructure of powder compact 600 and comprises about two times the thickness of the coating layers 416 of powder particles 412. In another exemplary embodiment, the cellular network 616 has a substantially uniform average thickness between dispersed particles 614 of about 50 nm to about 5000 nm.

Nanomatrix 616 is formed by sintering metallic coating layers 416 of adjacent particles to one another by interdiffusion and creation of bond layer 619 as described herein. Metallic coating layers 416 may be single layer or multilayer structures, and they may be selected to promote or inhibit diffusion, or both, within the layer or between the layers of metallic coating layer 416, or between the metallic coating layer 416 and particle core 414, or between the metallic coating layer 416 and the metallic coating layer 416 of an adjacent powder particle, the extent of interdiffusion of metallic coating layers 416 during sintering may be limited or extensive depending on the coating thicknesses, coating material or materials selected, the sintering conditions and other factors. Given the potential complexity of the interdiffusion and interaction of the constituents, description of the resulting chemical composition of nanomatrix 616 and nanomatrix material 620 may be simply understood to be a combination of the constituents of coating layers 416 that may also include one or more constituents of dispersed particles 614, depending on the extent of interdiffusion, if any, that occurs between the dispersed particles 614 and the nanomatrix 616. Similarly, the chemical composition of dispersed particles 614 and particle core material 618 may be simply understood to be a combination of the constituents of particle core 414 that may also include one or more constituents of nanomatrix 616 and nanomatrix material 620, depending on the extent of interdiffusion, if any, that occurs between the dispersed particles 614 and the nanomatrix 616.

In an exemplary embodiment, the nanomatrix material 620 has a chemical composition and the particle core material 618 has a chemical composition that is different from that of nanomatrix material 620, and the differences in the chemical compositions may be configured to provide a selectable and controllable dissolution rate, including a selectable transition from a very low dissolution rate to a very rapid dissolution rate, in response to a controlled change in a property or condition of the wellbore proximate the compact 600, including a property change in a wellbore fluid that is in contact with the powder compact 600, as described herein. Nanomatrix 616 may be formed from powder particles 412 having single layer and multilayer coating layers 416. This design flexibility provides a large number of material combinations, particularly in the case of multilayer coating layers 416, that can be utilized to tailor the cellular nanomatrix 616 and composition of nanomatrix material 620 by controlling the interaction of the coating layer constituents, both within a given layer, as well as between a coating layer 416 and the particle core 414 with which it is associated or a coating layer 416 of an adjacent powder particle 412. Several exemplary embodiments that demonstrate this flexibility are provided below.

As illustrated in FIG. 8, in an exemplary embodiment, powder compact 600 is formed from powder particles 412 where the coating layer 416 comprises a single layer, and the resulting nanomatrix 616 between adjacent ones of the plurality of dispersed particles 614 comprises the single metallic coating layer 416 of one powder particle 412, a bond layer 619 and the single coating layer 416 of another one of the adjacent powder particles 412. The thickness (t) of bond layer 619 is determined by the extent of the interdiffusion between the single metallic coating layers 416, and may encompass the entire thickness of nanomatrix 616 or only a portion thereof. In one exemplary embodiment of powder compact 600 formed using a single layer powder 410, powder compact 600 may include dispersed particles 614 comprising Mg, Al, Zn or Mn, or a combination thereof, as described herein, and nanomatrix 616 may include Al, Zn, Mn, Mg, Mo, W, Cu, Fe, Si, Ca, Co, Ta, Re or Ni, or an oxide, carbide or nitride thereof, or a combination of any of the aforementioned materials, including combinations where the nanomatrix material 620 of cellular nanomatrix 616, including bond layer 619, has a chemical composition and the core material 618 of dispersed particles 614 has a chemical composition that is different than the chemical composition of nanomatrix material 616. The difference in the chemical composition of the nanomatrix material 620 and the core material 618 may be used to provide selectable and controllable dissolution in response to a change in a property of a wellbore, including a wellbore fluid, as described herein. In a further exemplary embodiment of a powder compact 600 formed from a powder 410 having a single coating layer configuration, dispersed particles 614 include Mg, Al, Zn or Mn, or a combination thereof, and the cellular nanomatrix 616 includes Al or Ni, or a combination thereof.

Figure 9:
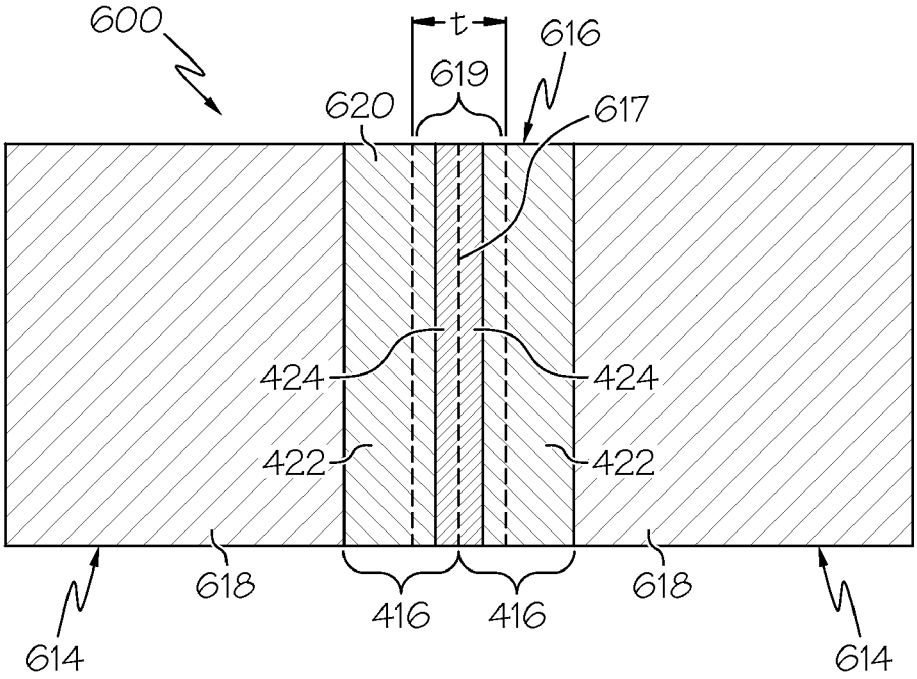
FIG. 9 is a schematic of illustration of another exemplary embodiment of the powder compact of FIG. 7 made using a powder having multilayer powder particles as it would appear taken along section 8-8.

As illustrated in FIG. 9, in another exemplary embodiment, powder compact 600 is formed from powder particles 412 where the coating layer 416 comprises a multilayer coating layer 416 having a plurality of coating layers, and the resulting nanomatrix 616 between adjacent ones of the plurality of dispersed particles 614 comprises the plurality of layers (t) comprising the coating layer 416 of one particle 412, a bond layer 619, and the plurality of layers comprising the coating layer 416 of another one of powder particles 412. In FIG. 9, this is illustrated with a two-layer metallic coating layer 416, but it will be understood that the plurality of layers of multilayer metallic coating layer 416 may include any desired number of layers. The thickness (t) of the bond layer 619 is again determined by the extent of the interdiffusion between the plurality of layers of the respective coating layers 416, and may encompass the entire thickness of nanomatrix 616 or only a portion thereof. In this embodiment, the plurality of layers comprising each coating layer 416 may be used to control interdiffusion and formation of bond layer 619 and thickness (t).

Sintered and forged powder compacts 600 that include dispersed particles 614 comprising Mg and nanomatrix 616 comprising various nanomatrix materials as described herein have demonstrated an excellent combination of mechanical strength and low density that exemplify the lightweight, high-strength materials disclosed herein. Examples of powder compacts 600 that have pure Mg dispersed particles 614 and various nanomatrices 616 formed from powders 410 having pure Mg particle cores 414 and various single and multilayer metallic coating layers 416 that include Al, Ni, W or $Al_2O_3$, or a combination thereof. These powders compacts 600 have been subjected to various mechanical and other testing, including density testing, and their dissolution and mechanical property degradation behavior has also been characterized as disclosed herein. The results indicate that these materials may be configured to provide a wide range of selectable and controllable corrosion or dissolution behavior from very low corrosion rates to extremely high corrosion rates, particularly corrosion rates that are both lower and higher than those of powder compacts that do not incorporate the cellular nanomatrix, such as a compact formed from pure Mg powder through the same compaction and sintering processes in comparison to those that include pure Mg dispersed particles in the various cellular nanomatrices described herein. These powder compacts 600 may also be configured to provide substantially enhanced properties as compared to powder compacts formed from pure Mg particles that do not include the nanoscale coatings described herein. Powder compacts 600 that include dispersed particles 614 comprising Mg and nanomatrix 616 comprising various nanomatrix materials 620 described herein have demonstrated room temperature compressive strengths of at least about 37 ksi, and have further demonstrated room temperature compressive strengths in excess of about 50 ksi, both dry and immersed in a solution of 3% KCl at 200° F. In contrast, powder compacts formed from pure Mg powders have a compressive strength of about 20 ksi or less. Strength of the nanomatrix powder metal compact 600 can be further improved by optimizing powder 410, particularly the weight percentage of the nanoscale metallic coating layers 416 that are used to form cellular nanomatrix 616. Strength of the nanomatrix powder metal compact 600 can be further improved by optimizing powder 410, particularly the weight percentage of the nanoscale metallic coating layers 416 that are used to form cellular nanomatrix 616. For example, varying the weight percentage (wt. %), i.e., thickness, of an alumina coating within a cellular nanomatrix 616 formed from coated powder particles 412 that include a multilayer ($Al/Al_2O_3/Al$) metallic coating layer 416 on pure Mg particle cores 414 provides an increase of 21% as compared to that of 0 wt % alumina.

Powder compacts 600 comprising dispersed particles 614 that include Mg and nanomatrix 616 that includes various nanomatrix materials as described herein have also demonstrated a room temperature sheer strength of at least about 20 ksi. This is in contrast with powder compacts formed from pure Mg powders which have room temperature sheer strengths of about 8 ksi.

Powder compacts 600 of the types disclosed herein are able to achieve an actual density that is substantially equal to the predetermined theoretical density of a compact material based on the composition of powder 410, including relative amounts of constituents of particle cores 414 and metallic coating layer 416, and are also described herein as being fully-dense powder compacts. Powder compacts 600 comprising dispersed particles that include Mg and nanomatrix 616 that includes various nanomatrix materials as described herein have demonstrated actual densities of about 1.738 $g/cm^3$ to about 2.50 $g/cm^3$, which are substantially equal to the predetermined theoretical densities, differing by at most 4% from the predetermined theoretical densities.

Figure 10:
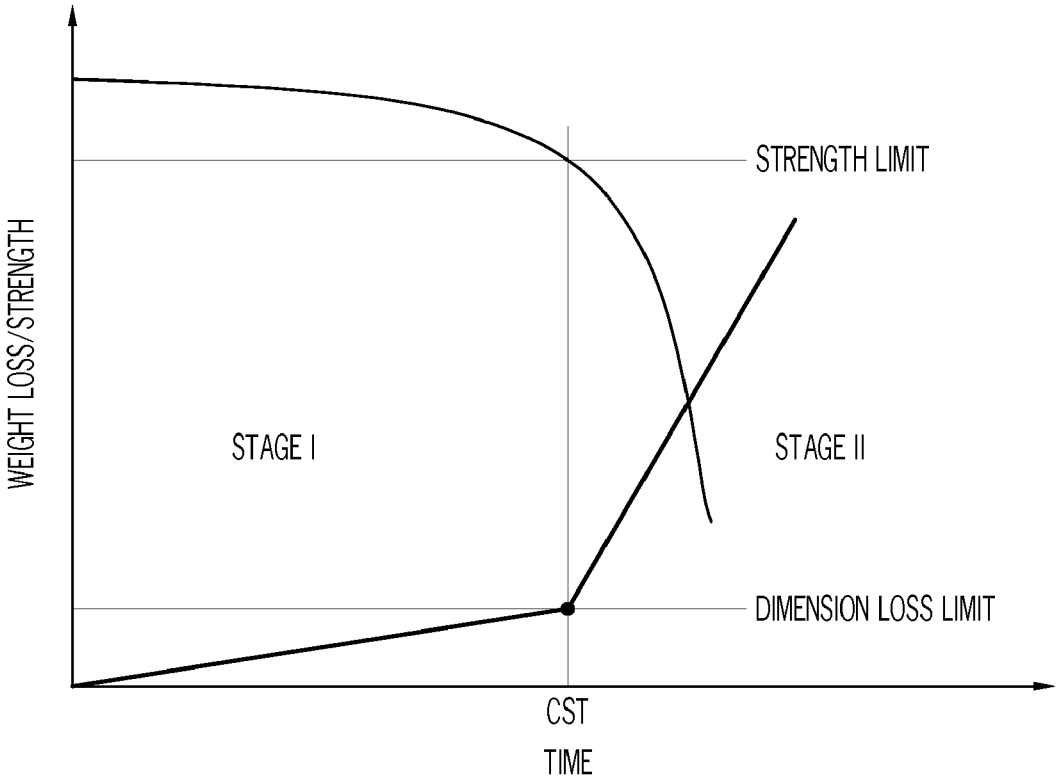
FIG. 10 is a schematic illustration of a change in a property of a powder compact as disclosed herein as a function of time and a change in condition of the powder compact environment.

Powder compacts 600 as disclosed herein may be configured to be selectively and controllably dissolvable in a wellbore fluid in response to a changed condition in a wellbore. Examples of the changed condition that may be exploited to provide selectable and controllable dissolvability include a change in temperature, change in pressure, change in flow rate, change in pH or change in chemical composition of the wellbore fluid, or a combination thereof. An example of a changed condition comprising a change in temperature includes a change in well bore fluid temperature. For example, powder compacts 600 comprising dispersed particles 614 that include Mg and cellular nanomatrix 616 that includes various nanomatrix materials as described herein have relatively low rates of corrosion in a 3% KCl solution at room temperature that range from about 0 to about 11 $mg/cm^2/hr$ as compared to relatively high rates of corrosion at 200° F. that range from about 1 to about 246 $mg/cm^2/hr$ depending on different nanoscale coating layers 416. An example of a changed condition comprising a change in chemical composition includes a change in a chloride ion concentration or pH value, or both, of the wellbore fluid. For example, powder compacts 600 comprising dispersed particles 614 that include Mg and nanomatrix 616 that includes various nanoscale coatings described herein demonstrate corrosion rates in 15% HCl that range from about 4750 $mg/cm^2/hr$ to about 7432 $mg/cm^2/hr$. Thus, selectable and controllable dissolvability in response to a changed condition in the wellbore, namely the change in the wellbore fluid chemical composition from KCl to HCl, may be used to achieve a characteristic response as illustrated graphically in FIG. 10, which illustrates that at a selected predetermined critical service time (CST) a changed condition may be imposed upon powder compact 600 as it is applied in a given application, such as a wellbore environment, that causes a controllable change in a property of powder compact 600 in response to a changed condition in the environment in which it is applied. For example, at a predetermined CST changing a wellbore fluid that is in contact with powder contact 600 from a first fluid (e.g. KCl) that provides a first corrosion rate and an associated weight loss or strength as a function of time to a second wellbore fluid (e.g., HCl) that provides a second corrosion rate and associated weight loss and strength as a function of time, wherein the corrosion rate associated with the first fluid is much less than the corrosion rate associated with the second fluid. This characteristic response to a change in wellbore fluid conditions may be used, for example, to associate the critical service time with a dimension loss limit or a minimum strength needed for a particular application, such that when a wellbore tool or component formed from powder compact 600 as disclosed herein is no longer needed in service in the wellbore (e.g., the CST) the condition in the wellbore (e.g., the chloride ion concentration of the wellbore fluid) may be changed to cause the rapid dissolution of powder compact 600 and its removal from the wellbore. In the example described above, powder compact 600 is selectably dissolvable at a rate that ranges from about 0 to about 7000 $mg/cm^2/hr$. This range of response provides, for example the ability to remove a 3 inch diameter ball formed from this material from a wellbore by altering the wellbore fluid in less than one hour. The selectable and controllable dissolvability behavior described above, coupled with the excellent strength and low density properties described herein, define a new engineered dispersed particle-nanomatrix material that is configured for contact with a fluid and configured to provide a selectable and controllable transition from one of a first strength condition to a second strength condition that is lower than a functional strength threshold, or a first weight loss amount to a second weight loss amount that is greater than a weight loss limit, as a function of time in contact with the fluid. The dispersed particle-nanomatrix composite is characteristic of the powder compacts 600 described herein and includes a cellular nanomatrix 616 of nanomatrix material 620, a plurality of dispersed particles 614 including particle core material 618 that is dispersed within the matrix. Nanomatrix 616 is characterized by a solid-state bond layer 619 which extends throughout the nanomatrix. The time in contact with the fluid described above may include the CST as described above. The CST may include a predetermined time that is desired or required to dissolve a predetermined portion of the powder compact 600 that is in contact with the fluid. The CST may also include a time corresponding to a change in the property of the engineered material or the fluid, or a combination thereof. In the case of a change of property of the engineered material, the change may include a change of a temperature of the engineered material. In the case where there is a change in the property of the fluid, the change may include the change in a fluid temperature, pressure, flow rate, chemical composition or pH or a combination thereof. Both the engineered material and the change in the property of the engineered material or the fluid, or a combination thereof, may be tailored to provide the desired CST response characteristic, including the rate of change of the particular property (e.g., weight loss, loss of strength) both prior to the CST (e.g., Stage 1) and after the CST (e.g., Stage 2), as illustrated in FIG. 10.

Without being limited by theory, powder compacts 600 are formed from coated powder particles 412 that include a particle core 414 and associated core material 418 as well as a metallic coating layer 416 and an associated metallic coating material 420 to form a substantially-continuous, three-dimensional, cellular nanomatrix 616 that includes a nanomatrix material 620 formed by sintering and the associated diffusion bonding of the respective coating layers 416 that includes a plurality of dispersed particles 614 of the particle core materials 618. This unique structure may include metastable combinations of materials that would be very difficult or impossible to form by solidification from a melt having the same relative amounts of the constituent materials. The coating layers and associated coating materials may be selected to provide selectable and controllable dissolution in a predetermined fluid environment, such as a wellbore environment, where the predetermined fluid may be a commonly used wellbore fluid that is either injected into the wellbore or extracted from the wellbore. As will be further understood from the description herein, controlled dissolution of the nanomatrix exposes the dispersed particles of the core materials. The particle core materials may also be selected to also provide selectable and controllable dissolution in the wellbore fluid. Alternately, they may also be selected to provide a particular mechanical property, such as compressive strength or sheer strength, to the powder compact 600, without necessarily providing selectable and controlled dissolution of the core materials themselves, since selectable and controlled dissolution of the nanomatrix material surrounding these particles will necessarily release them so that they are carried away by the wellbore fluid. The microstructural morphology of the substantially-continuous, cellular nanomatrix 616, which may be selected to provide a strengthening phase material, with dispersed particles 614, which may be selected to provide equiaxed dispersed particles 614, provides these powder compacts with enhanced mechanical properties, including compressive strength and sheer strength, since the resulting morphology of the nanomatrix/dispersed particles can be manipulated to provide strengthening through the processes that are akin to traditional strengthening mechanisms, such as grain size reduction, solution hardening through the use of impurity atoms, precipitation or age hardening and strength/work hardening mechanisms. The nanomatrix/dispersed particle structure tends to limit dislocation movement by virtue of the numerous particle nanomatrix interfaces, as well as interfaces between discrete layers within the nanomatrix material as described herein. This is exemplified in the fracture behavior of these materials. A powder compact 600 made using uncoated pure Mg powder and subjected to a shear stress sufficient to induce failure demonstrated intergranular fracture. In contrast, a powder compact 600 made using powder particles 412 having pure Mg powder particle cores 414 to form dispersed particles 614 and metallic coating layers 416 that includes Al to form nanomatrix 616 and subjected to a shear stress sufficient to induce failure demonstrated transgranular fracture and a substantially higher fracture stress as described herein. Because these materials have high-strength characteristics, the core material and coating material may be selected to utilize low density materials or other low density materials, such as low-density metals, ceramics, glasses or carbon, that otherwise would not provide the necessary strength characteristics for use in the desired applications, including wellbore tools and components.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of dissolving a tool comprising:

exposing an outer surface of the tool to an environment reactive with the tool;

chemically reacting the tool with the environment;

applying mechanical stress to the tool;

concentrating stress on the tool at stress risers in the outer surface;

accelerating structural degradation of the tool through chemical reactions at the stress risers; and initiating fracturing the tool at the stress risers.

2. The method of dissolving a tool of claim 1 further comprising indenting the tool at the stress risers.

3. The method of dissolving a tool of claim 1, further comprising controlling strength of the tool with the stress risers.

4. The method of dissolving a tool of claim 1, further comprising defining values of mechanical stress that will cause failure of the tool with the stress risers.

5. The method of dissolving a tool of claim 1, further comprising weakening the tool with the chemical reacting the tool with the environment.

6. The method of dissolving a tool of claim 1, further comprising concentrating stress at sharp intersections of surfaces within indentations that define the stress risers.

7. The method of dissolving a tool of claim 6, wherein the surfaces are flat surfaces.

8. The method of dissolving a tool of claim 6, wherein the indentations are cones.

9. The method of dissolving a tool of claim 1, further comprising embedding foreign matter into the tool.

10. The method of dissolving a tool of claim 9, further comprising exposing the foreign matter to the outer surface of the tool.

11. The method of dissolving a tool of claim 1, wherein the applying mechanical stress to the tool includes applying a pressure differential across a portion of the tool.

12. The method of dissolving a tool of claim 9, further comprising chemically reacting a portion of the body made of a powder metal compact, the compact comprising:

a substantially-continuous, cellular nanomatrix comprising a nanomatrix material;

a plurality of dispersed particles comprising a particle core material that comprises Mg, Al, Zn or Mn, or a combination thereof, dispersed in the cellular nanomatrix; and a solid-state bond layer extending throughout the cellular nanomatrix between the dispersed particles.

* * * * *